US005545002A

United States Patent [19]

Bourguignon et al.

[11] Patent Number: 5,545,002

[45] Date of Patent: Aug. 13, 1996

[54] STATOR VANE MOUNTING PLATFORM

[75] Inventors: Anne-Elisabeth F. Bourguignon, Saint Sauveur Sur Ecole; Pascal Fortunier; Guy R. E. Hebraudl, both of Vaux Le Penil, all of France

[73] Assignee: Societe Nationale D'Etude et de Construction de Moteurs D'Aviation S.N.E.C.M.A., Paris Cedex, France

[21] Appl. No.: 820,269

[22] Filed: Nov. 29, 1985

[30] Foreign Application Priority Data

Nov. 29, 1984 [FR] France ..... 84 18152

[51] Int. Cl.[6] ..... F01D 5/14

[52] U.S. Cl. ..... 415/115

[58] Field of Search ..... 60/266; 415/115, 415/196, 138, 177, 219 R; 416/214 A

[56] References Cited

U.S. PATENT DOCUMENTS

| | | | |
|---|---|---|---|
| 3,963,368 | 6/1976 | Emmerson | 415/115 |
| 4,113,406 | 9/1978 | Lee | 415/115 |
| 4,522,559 | 6/1985 | Burge | 415/196 |
| 4,650,395 | 3/1987 | Weidner | 415/116 |
| 4,659,282 | 4/1987 | Popp | 415/177 |
| 4,679,400 | 7/1987 | Kelm et al. | 60/722 |
| 4,693,667 | 9/1987 | Lenz et al. | 415/115 |

*Primary Examiner*—Harold Tudor
*Assistant Examiner*—Christopher K. Montgomery
*Attorney, Agent, or Firm*—Bacon & Thomas

[57] ABSTRACT

A stator vane mounting platform is disclosed which provides internal cooling chambers which facilitates the flow of cooling air through the chambers and thus, the cooling of the stator assembly. Baffles define an upstream chamber and a downstream cooling chamber between adjacent stator vanes so as to maximize the airflow and, consequently, the cooling effects of this airflow. The internal cooling chambers are defined by a thick wall and a relatively thin wall, the thin wall being in direct contact with the hot gases passing through the stator assembly. Mounting lugs and flanges are directly attached to the thicker wall so as to mount the stator assembly to the turbine engine structure and to accommodate all of the mechanical stresses encountered during the turbine engine operation.

17 Claims, 4 Drawing Sheets

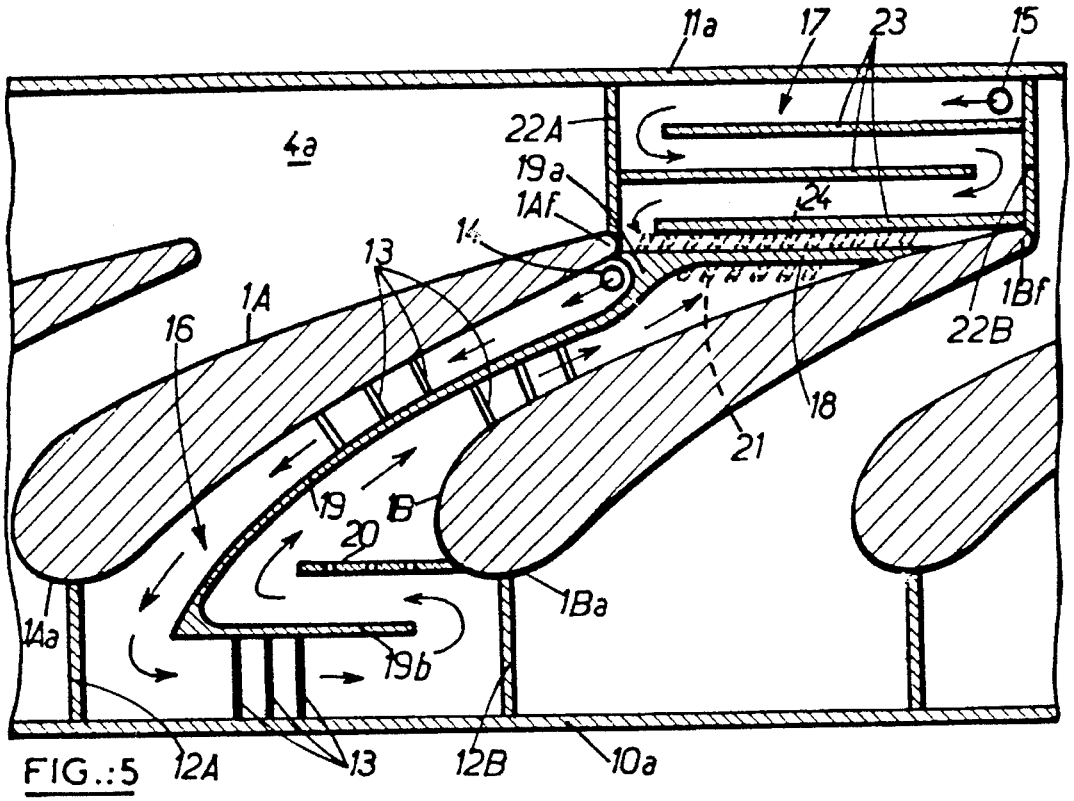
FIG.:5
FIG.:6
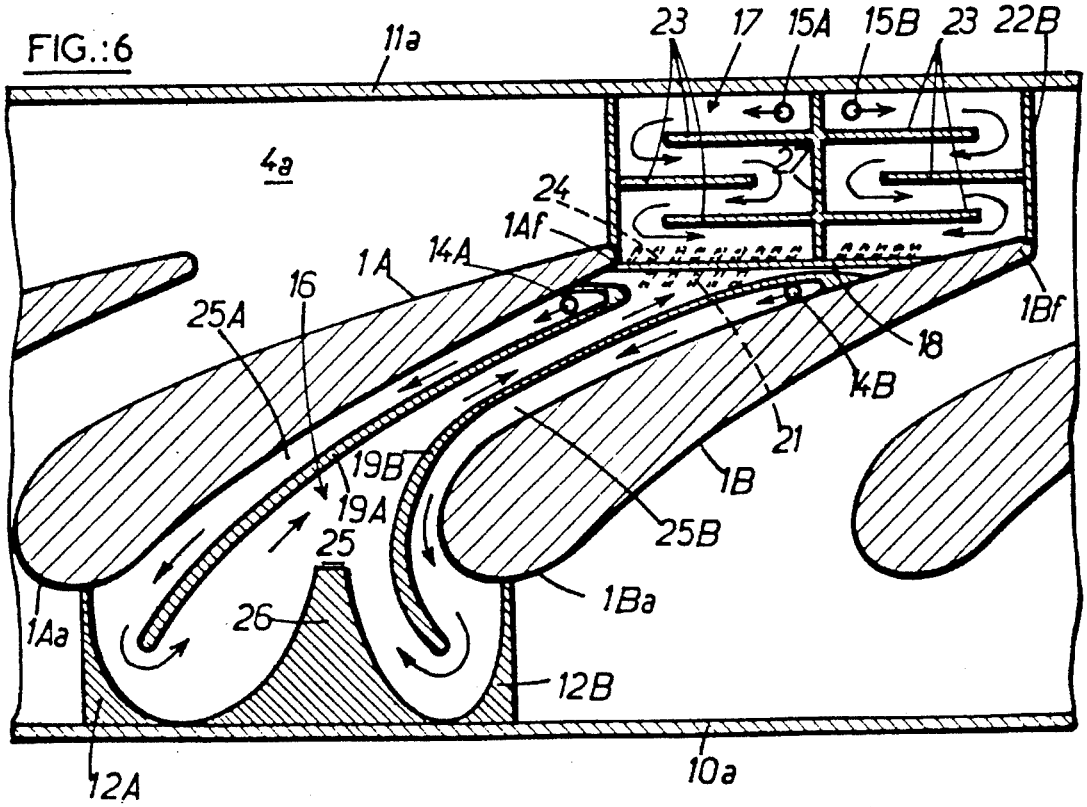

STATOR VANE MOUNTING PLATFORM

FIELD OF THE INVENTION

The present invention relates to an improved mounting platform for a stator vane utilized in a gas turbine engine.

BRIEF DESCRIPTION OF THE PRIOR ART

Turbines typically have at least one row of stator vanes disposed in a hot gaseous stream so as to redirect the hot gases onto the blades of a rotor wheel which is generally located adjacent to the stator assembly. The stator vanes are generally disposed in an annular array wherein each blade is oriented generally radially about a central axis of the turbine. Various means have been proposed over the years to attach the stator vanes to the turbine engine structure. Typically, these have included mounting platforms attached to each end region of the blade, the mounting platforms having means to be attached to the engine structure.

A known form of attachment for stator vanes is shown in FIG. 1 wherein one designates a stator vane disposed in the hot gaseous stream and disposed upstream of a rotor blade wheel (not shown). The radial ends 1*a* and 1*b* of each vane 1 are secured to mounting platforms 2*a* and 2*b* which are concentric with the axis of the turbine. Each of the two mounting platforms encloses and defines at least one internal chamber 3*a* and 3*b* which is bounded by a first perforated wall 4*a* and 4*b*, and a second perforated wall 5*a* and 5*b*.

As is also known in the art, the mounting platforms 2*a* and 2*b* may be formed as arcuate segments and means may be provided to attach the ends of the arcuate segments together so as to prevent the leakage of the hot gas through the joints. Thus, when assembled, the mounting platforms 2*b* form an external annular shroud, while the mounting platforms 2*a* form a concentric, inner annular shroud. Annular passageway 7 is defined between the inner and external annular shrouds through which flows the hot gases from one or more combustion chambers 6. Arrow f1 indicates the direction of flow of the hot gases leaving combustion chamber 6, the gases flowing between the adjacent stator blades 1 in the direction of arrow f2.

It is also known to provide cooling air to maintain the temperature of the stator vane assemblies within acceptable limits. Generally, the cooling air is taken from an upstream stage of the turbine compressor (not shown) and is directed onto the stator vane mounting platforms in the direction of arrows Fa and Fb. This cooling air passes through first perforated walls 4*a* and 4*b* into corresponding internal chambers 3*a* and 3*b* such that it impacts the internal surfaces of second walls 5*a* and 5*b* substantially perpendicular to these walls. Since second walls 5*a* and 5*b* are in direct contact with the hot gas flow, the impact of cooling air serves to maintain them at an acceptable working temperature.

In this known stator vane assembly, the second walls 5*a* or 5*b* of each of the mounting platforms has a radial thickness which is sufficient to permit it to withstand all of the mechanical stresses to which the mounting platforms 2*a* and 2*b* are subjected when the turbine is operating. The radial lugs 8*a* and 8*b*, which project radially from mounting platforms 2*a* and 2*b* on the opposite sides of annular passage 7 engage slots in the turbine engine structure so as to prevent relative circumferential movement between the stator vane assembly and the turbine engine structure. Radial flanges 9*a* and 9*b* also project from mounting platforms 2*a* and 2*b* so as to engage corresponding slots in the turbine engine structure. This engagement serves to prevent relative axial movement between the stator vane assembly and the turbine engine structure. Radial flanges 9*a* and 9*b* also extend from second wall 5*a* or 5*b* so as to transmit the working stresses thereto.

The first wall 4*a* or 4*b* of each mounting platform is essentially mechanically unstressed and may have a thickness significantly less than that of the corresponding second wall. This enables the first wall to be fabricated from a simple perforated plate of relatively small thickness.

The cooling air, which enters each of the internal chambers 3 circulates within the chamber to cool the second wall 5*a* or 5*b* by convection and then escapes into passage 7 through perforations formed in the second walls 5*a* and 5*b*. These passages are preferably inclined with respect to the turbine axis so as to enable the air escaping therethrough to form a cooling film along the walls 5*a* and 5*b*.

Turbine stator elements of this type are particularly shown in French patents 2,198,054; 2,374,508; and 2,316,440. In French patent 2,198,054, the internal chambers within the mounting platforms 3*a* and 3*b*, are each subdivided into several additional chambers by baffles which extend transversely to the first and second walls. These baffles serve to increase the heat exchange between the second walls and the cooling air by interfering with the flow of cooling air and slowing its flow rate.

This known form of stator vane mounting suffers from several disadvantages, however. The second walls 5*a* and 5*b* are not only subjected to mechanical stresses, through the lugs 8*a* and 8*b*, and the radial flanges 9*a* and 9*b*, it is also in direct contact with the hot gases passing through annular passage 7 and is, therefore, subjected to thermos tresses also. The combination of these stresses can reduce the service life of the stator element by causing cracks in the second walls 5*a* and 5*b*. Also, since radial flanges 9*a* and 9*b* are attached to this wall near its downstream edge portion, the internal cooling chambers 3*a* and 3*b* cannot extend into this downstream region. This limits the coverage of the internal cooling chambers and, consequently, the cooling abilities in the downstream region.

Attempts have been made to improve the cooling of the downstream end portion of the mounting platforms, as shown in French patent application 77.14615. This application provides an element made of thin perforated sheet metal which is placed on the projections at the hottest part of the second walls located downstream from the radial flanges such that the cooling air may flow through the perforations of this sheet metal element to cool the downstream part of the mounting platform which extends beyond the radial flange.

U.S. Pat. No. 3,963,368 to Emmerson describes a turbine stator element having internal cooling chambers in the stator mounting platform similar to that described in FIG. 1. However, the first, thinner wall is made of a material which permits cooling air to escape from the internal chamber through a great many pores leaving the cooling air in the annular passage of the stator element to exude. This device fails to permit the creation of the cooling films of air on the surface of the second walls which are in contact with the hot gases flowing through the stator assembly.

U.S. Pat. No. 4,012,167 to Noble also describes a turbine stator assembly having internal cooling passages in the mounting platforms. The upstream portion of each of the thick walls of each mounting platform which is in contact with the hot gases is simply cooled by a film of cooling air formed upon its contact surface. Supplementary cooling is provided in a zone extending under each stator vane and toward the downstream portion of its under surface. The supplementary cooling in these two zones is assured by cooling air impact in the internal chambers disposed in the corresponding zones of the mounting platforms by circulating air in these chambers and then forming cooling films by the cooling air ejected from these chambers through a plurality of passages. The downstream portion of each of the mounting platforms which is located beyond the trailing edges of the stator vanes is cooled by the circulation of cooling air through parallel channels disposed within the mounting platforms and emerges from its downstream edge. This structure clearly favors the cooling of the under surface of each stator vane and that part of its upper surface close to the downstream trailing edge. However, the rest of the mounting platform receives very inadequate cooling. British patent 1,572,410 also describes a turbine stator assembly having an internal chamber for cooling the downstream portion of the mounting platform. This downstream chamber includes baffles disposed so as to define at least one zigzag or serpentine channel having a first end supplied with cooling air from the internal cooling chamber of the upstream portion through a passage extending through the radial flange. The cooling air, upon leaving the serpentine channel, flows into a similar internal chamber to cool the upstream portion of another mounting platform, again through the passage disposed in the radial flange. This arrangement mechanically weakens the radial flange by the passages therethrough.

SUMMARY OF THE INVENTION

The present invention relates to a turbine stator assembly wherein the mounting platforms define an internal cooling chamber. A first perforated wall allows the cooling air to enter the internal chamber and contacts a second perforated wall which is in contact with the hot gases passing over the stator vanes. Perforations in the second walls allow the cooling air to exit the internal chamber and to form cooling air films along the surface of the second wall.

According to the invention, the first wall has a radial thickness substantially greater than that of the second wall and is provided with the mounting means for attaching the stator vane assembly to the turbine engine structure. Thus, the first, thicker wall provides the necessary rigidity to withstand virtually all of the mechanical stresses to which the mounting platform is subjected during the operation of the turbine engine. Since the second wall, that in contact with the hot gases, need not be capable of withstanding all of the mechanical stresses, it can be made substantially thinner than in the prior art devices. The second wall need only be able to withstand the thermal stresses, while the first, thicker wall withstands all of the mechanical stresses. This results in an increase of the service life of the turbine stator assembly and serves to avoid cracks in the first and second walls of the mounting platforms.

By forming the radial lugs and the radial flanges integrally with the first, thicker wall portion, it enables the internal cooling chamber to extend substantially without interruption, the entire width of the mounting platforms. This serves to effectively cool both the upstream and downstream edge portions without the necessity of additional baffle structures as in the prior art devices. Also, by having the internal chambers substantially uninterrupted throughout the width of the mounting platforms, the cooling air is allowed to circulate by convection and is, therefore, adapted to best cool the local heating conditions of the wall of the stator element which is in contact with the hot gases.

In a specific embodiment of the invention, the internal chamber which extends between a pair of adjacent stator vanes, is divided into an upstream cooling chamber, which extends from the upstream edge portion of the mounting platform to approximately the trailing edges of the stator vanes, and a downstream cooling chamber which extends from the trailing edges of the vanes to the downstream edge portion of the mounting platforms. This arrangement insures the best possible cooling of the mounting platform. In this embodiment, the upstream portion of the mounting platforms is not only cooled by a film formed on its surface from the cooling air source, but is also cooled by convection by air passing within the upstream cooling chamber. Similarly, the downstream portion of the mounting platform which extends from the trailing edge of the vanes to its downstream edge is also cooled by convection by air circulating through the downstream cooling chamber, as well as films of air formed by cooling air exiting from the internal cooling chambers. Baffles may be provided in both upstream and downstream cooling chambers to increase the travel path of the air passing through the chambers thereby increasing its cooling efficiency.

The improved mounting platform according to this invention may also be utilized in conjunction with a hollow stator vane structure. Such structures are wellknown in the art and provide internal cooling cavities within the stator vane to allow passage of cooling air therethrough. Means may be provided to permit the cooling air circulating in at least one of the internal chambers to be directed into the interior of the stator vane.

BRIEF DESCRIPTION OF THE DRAWINGS

FIG. 5 is a partial, sectional view taken along line V—V in FIG. 2.

FIG. 6 is a partial, sectional view of a second embodiment of the invention taken along line V—V in FIG. 2.

DETAILED DESCRIPTION OF THE PREFERRED EMBODIMENTS

Figure 1:
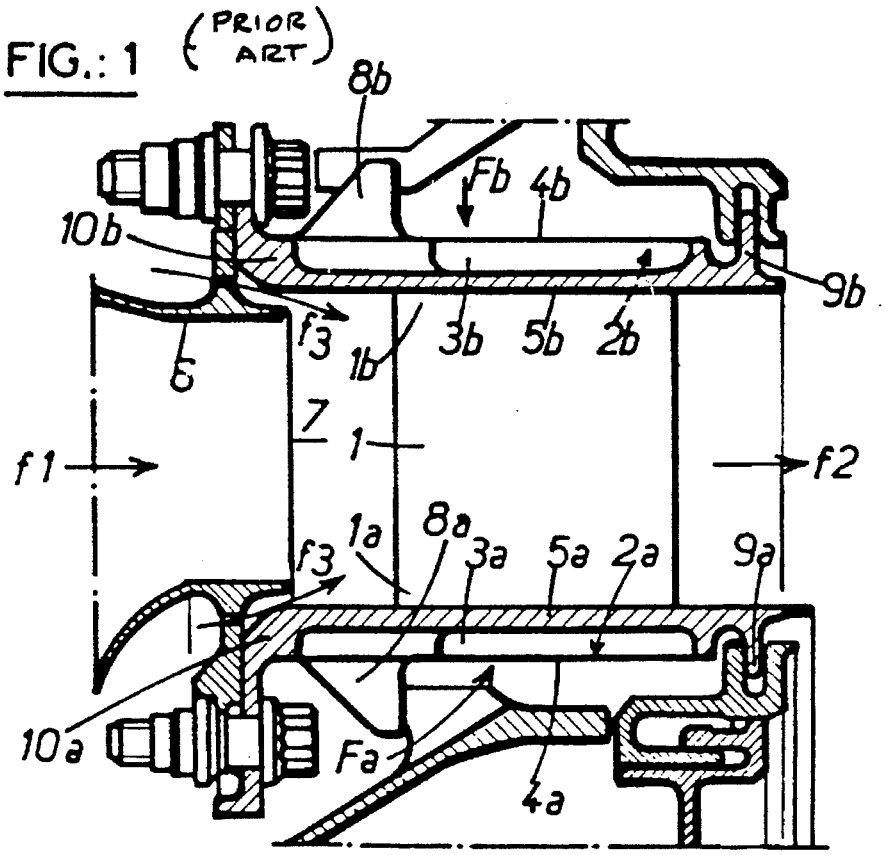
FIG.: 1 (PRIOR ART)
FIG. 1 is a partial, sectional side view showing a stator vane assembly according to the prior art.

A first embodiment of the invention is shown in FIGS. 2–5 and those elements having similar functions to the prior art device shown in FIG. 1 have been assigned the same numbers. However, as can be seen, the first walls 4*a* and 4*b* have a radial thickness E that is substantially greater than the radial thickness e of the second walls 5*a* and 5*b*. In accordance with the invention, the thickness E of the first wall, 4*a* and 4*b* is selected large enough to give the mounting platforms 2*a* and 2*b* the requisite rigidity and to enable the first walls 4*a* and 4*b* to withstand all of the mechanical stresses to which the mounting platforms are subjected when the turbine is in operation. The radial lugs 8*a* and 8*b* and the radial flanges 9*a* and 9*b* are formed integral with the external surface of the first walls 4*a* and 4*b*, the wall which is not in direct contact with the hot gases flowing through annular passage 7. The radial ends 1*a* and 1*b* of the stator vane 1 passes through the second, thinner walls 5*a* and 5*b*, the internal chambers 3*a* and 3*b* and is attached to the first, thicker wall 4*a* and 4*b*. In this way, the mechanical forces generated by the hot gases striking the stator vanes, as well as the mechanical forces transmitted by vane 1 from opposite mounting platforms, are transmitted entirely to the first, thicker walls 4*a* and 4*b*. As particularly shown in FIG. 2, the internal cooling chambers 3*a* and 3*b* can extend substantially without interruption in the axial direction from the upstream radial end wall 10*a* and 10*b* to the immediate vicinity of the downstream radial end wall 11*a* and 11*b*.

Figure 3:
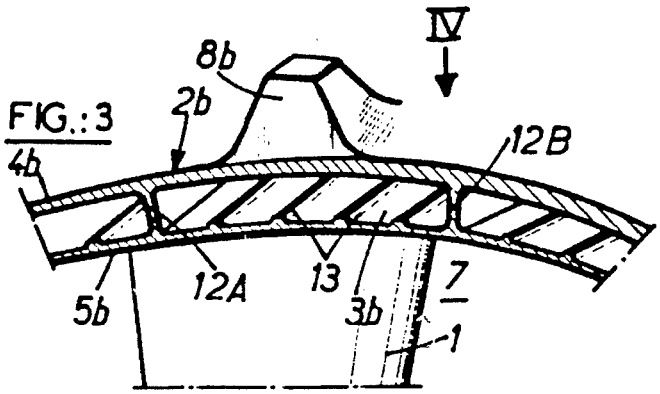
FIG. 3 is a partial, enlarged view taken along line III—III in FIG. 2.

FIG. 3 shows an enlarged portion of internal cooling chamber 3*b* which is separated from adjacent cooling chambers by radial baffles 12A and 12B. In addition, FIG. 3 shows that the second, thinner wall 5*b* may be provided on its internal surface with projections 13, the heights of which are substantially less than the height of the internal cooling chamber 3*b*. The projections 13 are designed to impede the flow of cooling air through chamber 3*b* by creating turbulence and thereby lengthening the path of the cooling air to increase the cooling efficiency. This is especially applicable to second, thinner wall 5*b*, since that wall is directly exposed to the hot gases passing through annular passage 7.

The mounting platforms 2*a* and 2*b* are typically constructed as segments of a circle, and may be constructed such that each segment mounts only a single stator vane. If this is the case, the junctions between adjacent platforms could be located at the radial baffles 12A and 12B, as shown in FIG. 3. However, the present invention is equally applicable to the structure wherein a plurality of stator vanes are attached to each platform segment.

Figure 2:
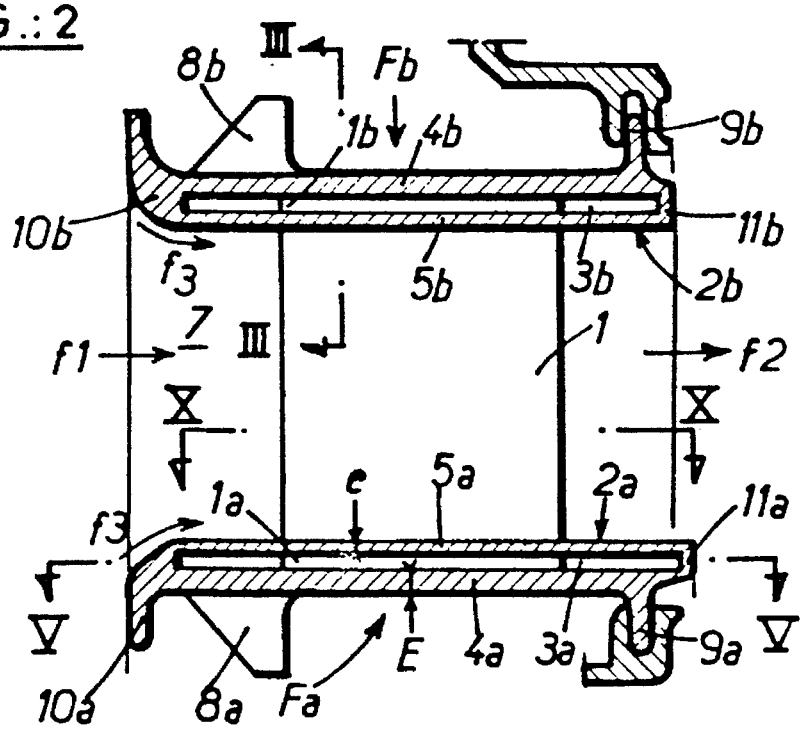
FIG. 2 is a partial, sectional side view showing the improved stator vane mounting platform according to the invention.
Figure 4:
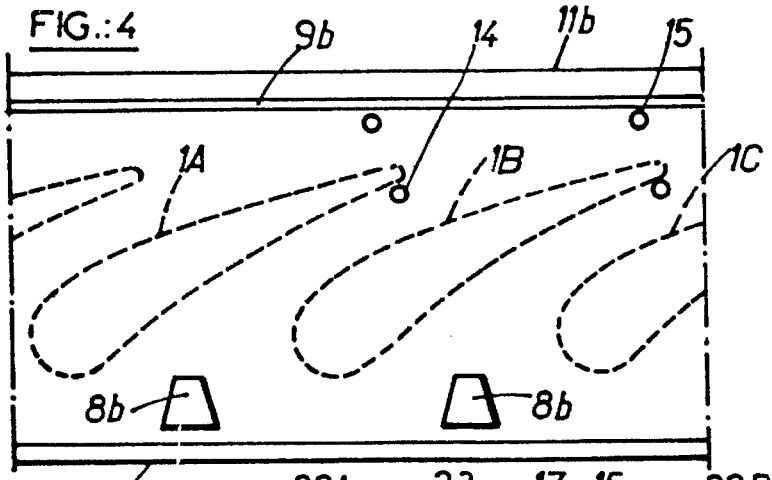
FIG. 4 is a plan view of the stator mounting platform taken in the direction of arrow IV in FIG. 3.

First walls 4*a* and 4*b* define cooling air inlet openings 14 and 15, as shown in FIG. 4. The purpose of these openings is to permit the cooling air flowing from the directions of arrows Fa and Fb (as shown in FIG. 2) to enter the internal cooling chambers 3*a* and 3*b*. The air entering through opening 14, for example, serves to cool the part of the mounting platform extending upstream from the adjacent vanes 1A and 1B, while air passing through opening 15 cools the downstream portion extending between the aforementioned vanes.

The first embodiment of the specific structure of the upstream and downstream cooling chambers is shown in FIG. 5. Baffles are located between adjacent stator vanes 1A and 1B which divide this internal chamber into an upstream cooling chamber 16 and a downstream cooling chamber 17. Baffle 18 which extends between the trailing edge portions 1Af and 1Bf separates the upstream chamber 16 from the downstream chamber 17. Baffles 12A and 12B extend from the leading edge portions 1Aa and 1Ba of the adjacent vanes to the radial end wall 10*a* to provide lateral limits for the upstream cooling chamber. Similarly, baffles 22A and 22B extend from the trailing edges 1Af and 1Bf of the stator vanes to downstream radial end wall 11*a* to provide lateral limits for the downstream cooling chamber 17.

Upstream cooling chamber 16 is further subdivided by baffle 19 which is joined to baffle 18 at 19*a* and extends in an upstream direction and terminates in an upstream edge. A second portion 19*b* extends from this upstream edge in a direction generally parallel to radial end wall 10*a* as shown in FIG. 5. A perforated baffle 20 extends from leading edge 1Ba of stator vane 1B toward the baffle 19 in a direction generally parallel to the portion 19*b* of this baffle. The flow of cooling air through this upstream chamber is clearly indicated by the arrows in applicants' FIG. 5. The air enters inlet opening 14 and passes between baffle 19 and one surface of stator vane 1A. The air then passes between baffle portion 19*b* and the radial end wall 10*a* before passing between baffles 19*b* and 20. The air then passes between baffle 19 and one surface of the adjacent stator vane 1B. The perforations in baffle 20 create additional turbulence in the cooling air to create vortex agitation and to avoid cooling air stagnation in this zone of the cooling chamber. The cooling air escapes from chamber 16 via passages 21 which are formed in second walls 5*a* and 5*b* to form a cooling air film on the exposed surface of these second walls. This cooling air film reinforces or replaces the cooling air film which had been formed on the external surface of the second walls 5*a* and 5*b* by the cooling air passing in the direction of arrows $f_3$ shown in FIGS. 1 and 2. As noted in FIG. 5, projections 13 can be disposed along the air path through chamber 16 to provide additional turbulence to the cooling air.

Baffles 23 are provided in downstream cooling chamber 17 so as to define a serpentine path for the cooling air entering opening 15. The air passing along this single, serpentine path, shown in FIG. 5, exits through oblique passages 24 formed in second walls 5*a* and 5*b*, respectively. Again, the air escaping through these passages forms a cooling air film on the exposed surface of walls 5*a* and 5*b*. Although not shown in FIG. 5, it is understood that projections 13 could also be employed in downstream cooling chamber 17 to create cooling air turbulence and to thereby increase the cooling efficiency of the air.

A second embodiment of the upstream and downstream cooling chambers is shown in FIG. 6. In this embodiment, baffles 19A and 19B extend from the trailing edge portions of stator vanes 1A and 1B to a position upstream of their leading edges 1Aa and 1Ba. These baffles define a first air channel 25A between baffle 19A and stator vane 1A, a second air path 25B between baffle 19B and stator vane 1B, and a third path 25 located between baffles 19A and 19B. As shown, the air enters chamber 16 through a pair of inlet openings 14A and 14B so as to travel along paths 25A and 25B. Baffle 26, which extends generally between the upstream edge portions of baffles 19A and 19B serves to redirect the air along these paths into central path 25. Once the cooling air has traversed along path 25, it exits through oblique passages 21 formed in walls 5*a* and 5*b* as in the previous embodiment.

Downstream cooling chamber 17 is also different from that shown in the embodiment of FIG. 5. As seen in FIG. 6, baffles 23 and longitudinal baffle 27 are arranged so as to provide a pair of adjacent, serpentine channels through which the cooling air must pass. The cooling air enters a pair of inlet openings 15A and 15B and, after passing along the serpentine paths, exits through oblique openings 24 formed in walls 5*a* and 5*b*.

Figure 7:
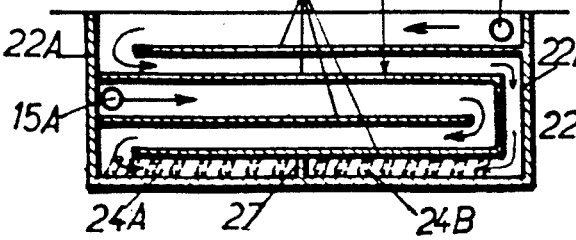
FIG. 7 is a partial, sectional view showing a third embodiment of the downstream cooling chamber according to the invention.
Figure 8:
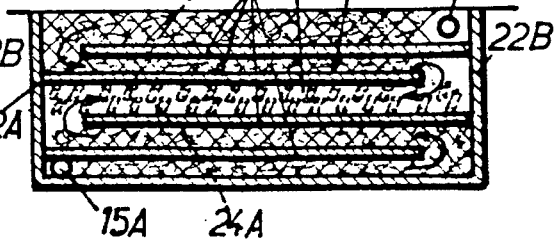
FIG. 8 is a partial, sectional view showing a fourth embodiment of the downstream cooling chamber according to the invention.

FIGS. 7 and 8 show alternative embodiments of the downstream cooling chamber. In FIG. 7, baffles 23 are arranged such that a pair of overlapping, serpentine channels are defined. The cooling air enters inlet openings 15A and 15B and, after passing along the overlapping, serpentine channels, exits through oblique passages 24A and 24B to form the cooling air films along second walls 5*a* and 5*b*. In this embodiment, as well as in the previously discussed embodiments, it is possible to dispose projections 13 transverse to the air flow through the downstream cooling chamber so as to generate increased turbulence and thereby increase the cooling efficiency of the air.

In FIG. 8, baffles 23 are arranged so as to define a pair of serpentine air channels. Opening 15A supplies inlet air to the first channel while inlet opening 15B supplies air to the second channel. In this particular embodiment, the exit passages 24A and 24B are located such that they communicate with channel 28, intermediate the two serpentine paths. In this particular embodiment, the downstream chamber 17 is filled with a material made of alloy shavings designed to improve the heat exchange between the cooling air and the second walls 5*a* and 5*b*. These alloy shavings may be bound to each other and to the walls defining the channels by a diffusion brazing process. It is to be understood, that these alloy shavings could also replace the projections 13 in the various channels of the upstream cooling chamber 16. It is also envisioned that these alloy shavings could be replaced by a powder formed by nickel-chromium material.

Figure 9:
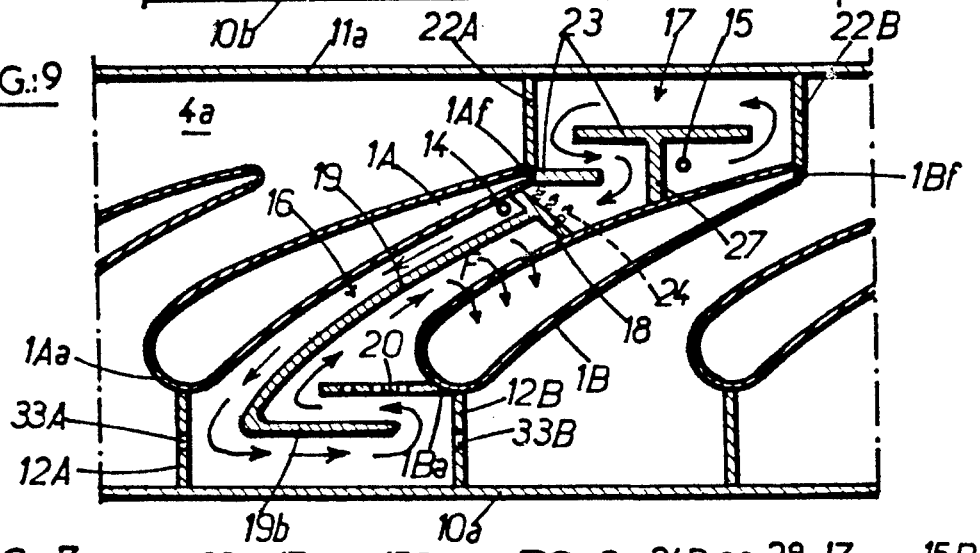
FIG. 9 is a partial, sectional view showing an alternative embodiment of the cooling chambers according to the invention taken along line V—V in FIG. 2.

In the embodiment shown in FIG. 9, the baffle 18 extends across the "throat" of the flow channel between vanes 1A and 1B, instead of between their trailing edges as in the previous embodiments. The cooling air path in this embodiment is substantially similar to that shown in FIG. 5, except that the air passes into the interior of the hollow vane 1B instead of passing through oblique exits 21, as shown in FIG. 5. The air passes into the hollow vane as indicated at F to circulate in the vane and cool it by convection. Baffles 23 in the downstream cooling chamber 17 are arranged so as to again define a single serpentine path for this cooling air. Again, air enters the inlet 15 and, after passing through this serpentine channel, exits through oblique passages 24. The oblique passages 24 are located adjacent baffle 18 such that the cooling film formed on the second walls 5*a* and 5*b* begins approximately at this "throat" area.

Figure 10:
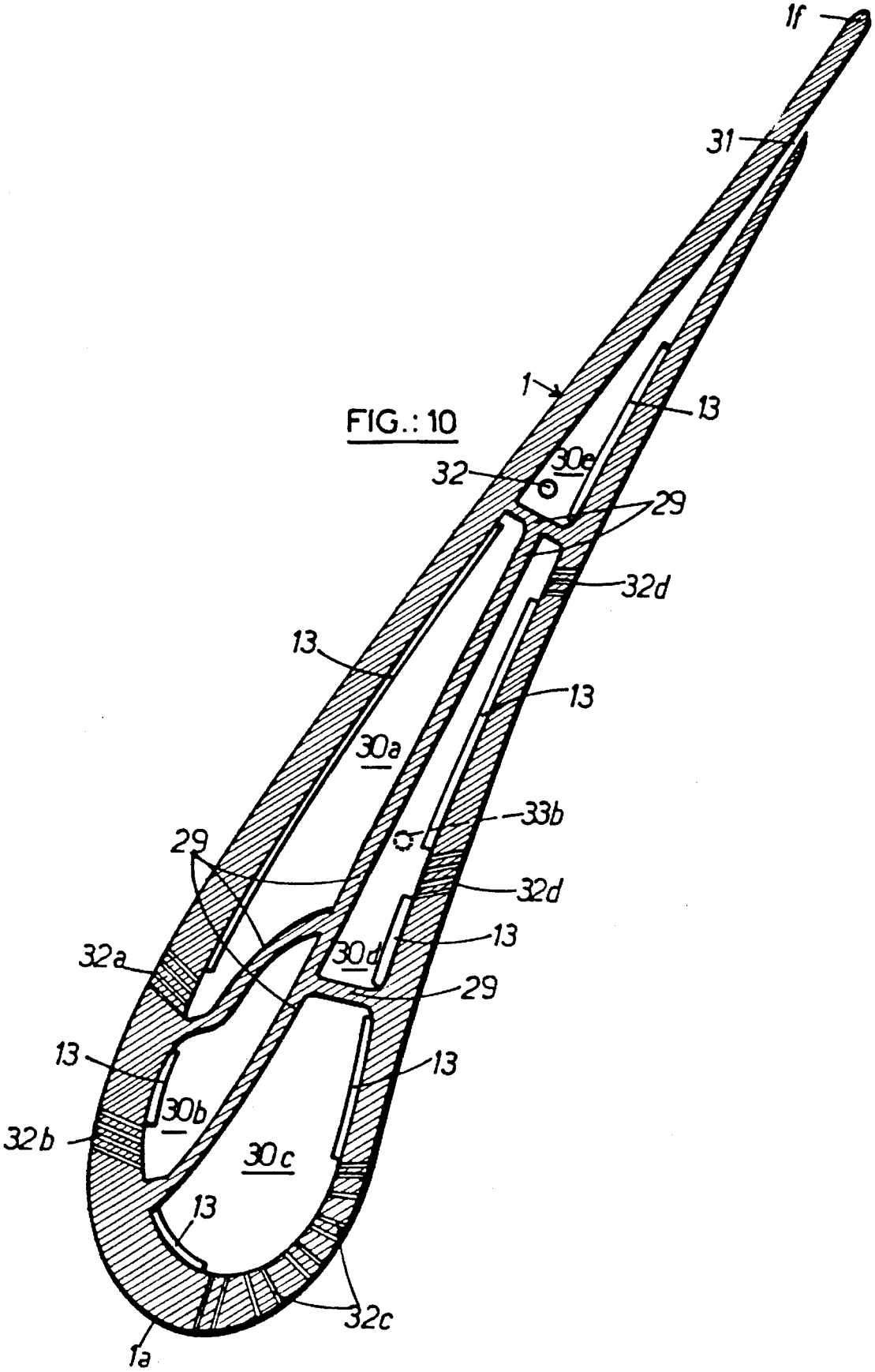
FIG. 10 is a cross sectional view taken along line X—X of FIG. 2 showing a hollow stator blade which may be utilized with the invention.

FIG. 10 shows a cross sectional view of a hollow stator vane in accordance with the present invention. The interior of the hollow vane is divided into a plurality of separate cavities 30*a*–30*e*, by baffles 29. Downstream cavity 30*e* extends throughout the length of the downstream portion of vane 1 and is open to the exterior of the vane 1 via slot 31. Slot 31 extends throughout the distance between the mounting platforms 2*a* and 2*b*. Projections 13, similar to that shown in FIG. 3, may be provided on the internal surfaces of the hollow vane 1 in different cavities to create cooling air turbulence inside the hollow vane.

The upper surface cavity 30*a* can be supplied with cooling air directly from upstream cooling chamber 16 (as seen in FIG. 9) from mounting platform 2*b* via the passages disposed across the wall of the upper surface of the vane at its corresponding radial end 1*b*. Cavities 30*b*, 30*c* and 30*d* may be supplied with cooling air from the upstream cooling chamber 16 associated with the mounting platform 2*a* through appropriate passages disposed in the wall of the corresponding radial end 1*a* of the vane at its leading edge and its under surface. As a result, the cooling air circulates in cavity 30*a* in the centripetal direction, whereas air circulates in the centripetal direction in cavities 30*b*, 30*c* and 30*d*. It is particularly advantageous that the upper surface cavities 30*a* and 30*b* are traversed by air that has already circulated in an internal chamber of at least one of the two mounting platforms to which the hollow vane is fastened. Often the temperature of the air that has already cooled one of the mounting platforms is high enough to slightly reheat the wall of the upper surface of hollow vane 1, the surface temperature of which is often too low. It is necessary to cool the walls of cavity 30*e* since the walls often have a very high operating temperature. Cavity 30*e* is supplied with cooling air at relatively low temperatures which may be supplied directly to the cavity via inlet opening 32 formed in the first wall 4*a* or 4*b*. The cooling air that has circulated in the various cavities 30*a*–30*e* may escape via rows of very small holes (approximately 0.5 millimeters in diameter) 32*a*–32*d* located in appropriate positions in the upper surface, the leading edge and the under surface of hollow vane 1, respectively.

The internal cooling cavities of the hollow vanes may of course be varied, as may the number and arrangement of internal baffles 29. The number and arrangement of openings for allowing the air to discharge from the hollow vane are also optional, as is the use and arrangement of the projections 13. The same arrangements are also applicable where at least one of the two radial ends of each of the hollow vanes is fastened to the first wall of the corresponding mounting platform by a tenon traversing at least one of the internal chambers of the mounting platform in accordance with the known techniques. In this case, the hollow vane may be supplied with cooling air by a duct traversing the mounting platform in an approximately radial direction and, if required, the baffle closing the corresponding radial end of the hollow vane. The supply of cooling air can also be provided in this case as a supplement or as a variant, by passages communicating the interior of the hollow vane with the internal chamber of the corresponding mounting platform.

The present invention covers all means making it possible to cause the circulation in at least one hollow vane of the stator assembly, of at least a fraction of the cooling air that has already circulated in at least one of the internal cooling chambers to which the radial ends of the vane are fastened. The upstream and downstream cooling chambers may be in communication with each other, and appropriate passages 33A and 33B may be provided in baffles 12A and 12B, respectively, to allow adjacent chambers to communicate with each other to balance the pressures between the contiguous chambers.

The foregoing description is provided for illustrative purposes only and should not be construed as in any way limiting this invention, the scope of which is defined solely by the appended claims.

What is claimed is:

1. In a turbine engine having a plurality of stator vanes located in a passage for high-temperature gas, the stator vanes being oriented generally radially about a central axis of the turbine engine and having radially inner and outer mounting platforms interconnecting the radially inner and outer ends of the stator vanes, the improvement wherein at least one of the mounting platforms comprises:

a) an internal chamber defined by: a first wall extending generally parallel to the central axis of the turbine and having a first thickness, the first wall being attached to an end of the stator vanes; a second wall extending generally parallel to the first wall and having a second thickness such that the first thickness is substantially greater than the second thickness, the second wall being in contact with high-temperature gases; and, upstream and downstream radial walls interconnecting upstream ends of the first and second walls, and downstream ends of the first and second walls;

b) a source of cooling air;

c) cooling openings defined by the first wall to allow cooling air to pass into the internal chamber;

d) means to allow cooling air to exit from the internal chamber so as to form a cooling film on the second wall; and, e) mounting means on the first wall for mounting the stator vanes to the turbine engine structure such that mechanical stresses are transmitted between the engine structure and the first wall.

2. The improved stator vane mounting platform according to claim 1 wherein the mounting means comprises a plurality of radially extending, circumferentially spaced lugs formed integrally with the first wall, and a radially extending flange formed integrally with the first wall, the lugs and the flange preventing relative rotational and axial movement between the stator vane mounting assembly and the turbine engine structure.

3. The improved stator vane mounting platform according to claim 2 wherein the internal chamber extends without interruption in the axial direction from the upstream radial wall to the downstream radial wall.

4. The improved stator vane mounting platform according to claim 1 wherein the internal chamber extends between an adjacent pair of stator vanes and further comprising:

a) first baffle means extending between adjacent stator vanes;

b) second baffle means extending from leading edges of the adjacent stator vanes to the upstream radial wall to define an upstream chamber;

c) third baffle means extending from trailing edges of the adjacent stator vanes to the downstream radial wall to define a downstream chamber;

d) at least one first inlet opening defined by the first wall to allow cooling air to pass into the upstream chamber; and, e) at least one second inlet opening defined by the first wall to allow cooling air to pass into the downstream chamber.

5. The improved stator vane mounting platform according to claim 4 further comprising a fourth baffle means having a first portion extending between the adjacent pair of stator vanes from the first baffle means and terminating in an upstream edge near the upstream radial wall, and a second portion extending from the upstream edge generally parallel to the upstream radial wall.

6. The improved stator vane mounting platform according to claim 5 further comprising fifth baffle means located in the downstream chamber so as to direct the cooling air through the downstream chamber along a serpentine path.

7. The improved stator vane mounting platform according to claim 6 further comprising a sixth baffle attached to a leading edge of one of the adjacent pair of stator vanes and extending toward the first portion of the fourth baffle means in a direction generally parallel to the second portion of the fourth baffle means.

8. The improved stator vane mounting platform according to claim 7 wherein the sixth baffle defines a plurality of openings therethrough.

9. The improved stator vane mounting platform according to claim 5 wherein the first inlet opening is located between the first portion of the fourth baffle means and one of the adjacent stator vanes.

10. The improved stator vane mounting platform according to claim 5 further comprising a plurality of internal projections extending from the second wall into the upstream chamber so as to increase the turbulence of the cooling air passing through the chamber.

11. The improved stator vane mounting platform according to claim 4 further comprising:

a) a fourth baffle member extending from a trailing edge portion of a first of the adjacent pair of stator vanes toward the upstream radial wall and terminating in a first upstream edge so as to define a first cooling air path between the fourth baffle and the first stator vane;

b) a fifth baffle member extending from a trailing edge portion of a second of the adjacent pair of stator vanes toward the upstream radial wall and terminating in a second upstream edge so as to define a second cooling air path between the fifth baffle and the second stator vane, and so as to define a third cooling air path between the fourth and fifth baffle members;

c) a first inlet opening defined by the first wall and located so as to allow cooling air to enter the first cooling air path;

d) a second inlet opening defined by the first wall and located so as to allow cooling air to enger the second cooling air path; and, e) a sixth baffle member extending from the upstream radial wall in a downstream direction between the upstream edge portions of the fourth and fifth baffle members.

12. The improved stator vane mounting platform according to claim 11 further comprising seventh baffle means located in the downstream chamber so as to direct the cooling air through the downstream chamber along a serpentine path.

13. The improved stator vane mounting platform according to claim 11 further comprising a plurality of exit openings defined by the second wall and communicating with the third cooling air path so as to allow cooling air to exit from the upstream chamber to form a cooling air film on the second wall.

14. The improved stator vane mounting platform according to claim 4 wherein the stator vanes are hollow throughout their length and a plurality of cooling orifices are defined by the stator vane so as to communicate with the internal chamber.

15. The improved stator vane mounting platform according to claim 14 further comprising internal wall means located within the hollow stator vanes so as to divide the interior into a plurality of internal cavities.

16. The improved stator vane mounting platform according to claim 15 further comprising means to allow a portion of the internal cavities to communicate with the internal chamber of a first mounting platform and means to allow a remaining portion of the internal cavities to communicate with the internal chamber of a second mounting platform.

17. The improved stator vane mounting platform according to claim 14 further comprising at least one second cooling orifice defined by the first wall and communicating with the interior of the hollow stator vane.

* * * * *